US009268348B2

(12) United States Patent
Yang

(10) Patent No.: US 9,268,348 B2
(45) Date of Patent: Feb. 23, 2016

(54) REFERENCE POWER GENERATING CIRCUIT AND ELECTRONIC CIRCUIT USING THE SAME

(71) Applicant: Muh-Rong Yang, Taipei (TW)

(72) Inventor: Muh-Rong Yang, Taipei (TW)

(73) Assignee: Midastek Microelectronic Inc., Taipei (TW)

( * ) Notice: Subject to any disclaimer, the term of this patent is extended or adjusted under 35 U.S.C. 154(b) by 29 days.

(21) Appl. No.: 14/287,064

(22) Filed: May 26, 2014

(65) Prior Publication Data

US 2015/0261234 A1 Sep. 17, 2015

(30) Foreign Application Priority Data

Mar. 11, 2014 (TW) ..... 103108396 A

(51) Int. Cl.
*G05F 1/46* (2006.01)
*G05F 3/30* (2006.01)

(52) U.S. Cl.
CPC . *G05F 1/468* (2013.01); *G05F 3/30* (2013.01)

(58) Field of Classification Search
CPC ..... G05F 3/30; G05F 1/46; G05F 3/16; G05F 3/267
USPC ..... 323/313–316; 327/538–546
See application file for complete search history.

(56) References Cited

U.S. PATENT DOCUMENTS 4,525,663 A * 6/1985 Henry ..... 323/280
4,789,797 A * 12/1988 Vasseghi ..... 326/75
5,072,136 A * 12/1991 Naghshineh ..... 326/126
5,424,628 A * 6/1995 Nguyen ..... 323/314
5,774,013 A * 6/1998 Groe ..... 327/543
5,796,244 A * 8/1998 Chen et al. ..... 323/313
6,118,264 A * 9/2000 Capici ..... 323/316
6,642,776 B1 * 11/2003 Micheloni et al. ..... 327/539
7,560,979 B1 * 7/2009 Hsu et al. ..... 327/539
7,724,068 B1 * 5/2010 Smith et al. ..... 327/513
2002/0158682 A1 * 10/2002 Conte et al. ..... 327/539
2003/0151957 A1 * 8/2003 Pekny ..... 365/189.11
2005/0046466 A1 * 3/2005 Koelling ..... 327/539

(Continued)

FOREIGN PATENT DOCUMENTS

CN 101414197 9/2010
CN 102478877 5/2012

(Continued)

OTHER PUBLICATIONS

"Office Action of Taiwan Counterpart Application", issued on May 13, 2015, pp. 1-4.

*Primary Examiner* — Timothy J Dole
*Assistant Examiner* — Yusef Ahmed
(74) *Attorney, Agent, or Firm* — Jianq Chyun IP Office

(57) ABSTRACT

A reference power generating circuit and an electronic circuit using the same are provided. The reference power generating circuit includes a first bandgap reference circuit and a second bandgap reference circuit. The first bandgap reference circuit is biased by a power voltage to generate a first reference voltage, where the first reference voltage has a first offset. The second bandgap reference circuit is connected to the first bandgap reference circuit in series and receives the first reference voltage generated by the first bandgap reference circuit. The second bandgap reference circuit is biased by the first reference voltage to generate a baseline reference voltage. The baseline reference voltage has a second offset, and the second offset is smaller than the first offset.

4 Claims, 4 Drawing Sheets

(56) References Cited

U.S. PATENT DOCUMENTS

| | | | | |
|---|---|---|---|---|
| 2005/0242799 | A1* | 11/2005 | Erdelyi et al. | 323/312 |
| 2005/0264345 | A1* | 12/2005 | Ker et al. | 327/539 |
| 2006/0043957 | A1* | 3/2006 | Carvalho | 323/313 |
| 2007/0040543 | A1* | 2/2007 | Yeo et al. | 323/313 |
| 2007/0046363 | A1* | 3/2007 | Tanzawa | 327/539 |
| 2007/0139030 | A1* | 6/2007 | Lee et al. | 323/315 |
| 2007/0210857 | A1* | 9/2007 | Wu et al. | 327/541 |
| 2008/0104434 | A1* | 5/2008 | May | 713/322 |
| 2009/0058390 | A1* | 3/2009 | Irmscher | 323/313 |
| 2009/0058512 | A1* | 3/2009 | Huang | 327/539 |
| 2009/0121699 | A1* | 5/2009 | Park et al. | 323/313 |
| 2009/0261801 | A1* | 10/2009 | Jurasek et al. | 323/313 |
| 2010/0117721 | A1* | 5/2010 | Hsieh et al. | 327/539 |
| 2010/0164468 | A1* | 7/2010 | Dix | 323/313 |
| 2010/0164609 | A1* | 7/2010 | Yoo | 327/542 |
| 2010/0213918 | A1* | 8/2010 | Lu et al. | 323/314 |
| 2010/0237925 | A1* | 9/2010 | Lin | 327/299 |
| 2012/0062311 | A1* | 3/2012 | Chen et al. | 327/535 |
| 2013/0043859 | A1* | 2/2013 | Theoduloz et al. | 323/313 |
| 2013/0099770 | A1* | 4/2013 | Cheng | 323/313 |
| 2013/0106389 | A1* | 5/2013 | Routray | 323/313 |
| 2013/0162341 | A1* | 6/2013 | Temkine et al. | 327/539 |
| 2013/0300396 | A1* | 11/2013 | Chen | 323/313 |
| 2013/0314068 | A1 | 11/2013 | Zhen et al. | |
| 2014/0185401 | A1* | 7/2014 | Yang et al. | 365/207 |

FOREIGN PATENT DOCUMENTS

| | | |
|---|---|---|
| JP | 2013089038 | 5/2013 |
| TW | 201248351 | 12/2012 |
| WO | 2011107160 | 9/2011 |

* cited by examiner

REFERENCE POWER GENERATING CIRCUIT AND ELECTRONIC CIRCUIT USING THE SAME

CROSS-REFERENCE TO RELATED APPLICATION

This application claims the priority benefit of Taiwan application serial no. 103108396, filed on Mar. 11, 2014. The entirety of the above-mentioned patent application is hereby incorporated by reference herein and made a part of this specification.

BACKGROUND

1. Technical Field

The invention relates to a reference power generating circuit and an application thereof, and particularly relates to a reference power generating circuit capable of decreasing an output offset and an electronic circuit using the same.

2. Related Art

A bandgap reference circuit is generally used to generate a stable baseline reference voltage that is not influenced by temperature. In the domain of circuit design, the bandgap reference circuit is widely used in circuits requiring an accurate working reference power, for example, an oscillating circuit or a digital-to-analog converter, etc.

Under the existing technique, since a circuit component itself has non-ideal characteristics on hardware, if the baseline reference voltage is simply produced by the bandgap reference circuit, it is still inadequate to prevent the generated baseline reference voltage from being influenced by unexpected situations such as a process variation, a temperature variation and a power drift, etc. In other words, the baseline reference voltage generated by a general bandgap reference circuit still has a considerable degree of offset, which may worsen an output characteristic of an electronic circuit requiring a high-accuracy working reference power.

In this case, a commonly used circuit design means is to design an additional compensation circuit to compensate an operation of the bandgap reference circuit, so as to improve the accuracy of the baseline reference voltage. However, a designer has to spend additional time and effort to design a structure of the compensation circuit. Moreover, how to integrate the compensation circuit and the bandgap reference circuit is another problem in circuit design and circuit layout.

SUMMARY

The invention is directed to a reference power generating circuit and an electronic circuit using the same, by which an offset of an output baseline reference voltage is effectively decreased without adding an additional compensation circuit.

The invention provides a reference power generating circuit including a first bandgap reference circuit and a second bandgap reference circuit. The first bandgap reference circuit is biased by a power voltage to generate a first reference voltage, where the first reference voltage has a first offset. The second bandgap reference circuit is connected to the first bandgap reference circuit in series and receives the first reference voltage generated by the first bandgap reference circuit. The second bandgap reference circuit is biased by the first reference voltage to generate a baseline reference voltage. The baseline reference voltage has a second offset, and the second offset is smaller than the first offset.

In an embodiment of the invention, the reference power generating circuit further includes at least one compensation circuit. The compensation circuit is used to perform a first-order or multi-order compensation on the first bandgap reference circuit, so as to simultaneously decrease the first offset and the second offset.

In an embodiment of the invention, the reference power generating circuit further includes a current generating circuit. The current generating circuit is coupled to the second bandgap reference circuit, and is biased by the baseline reference voltage to generate a baseline reference current.

In an embodiment of the invention, the first and the second bandgap reference circuits have a same circuit configuration.

In an embodiment of the invention, the first and second bandgap reference circuits have different circuit configurations.

The invention provides a reference power generating circuit including N-stage bandgap reference circuits connected in series to each other. Each stage of the bandgap reference circuit is biased by an output of a previous stage bandgap reference circuit to generate a reference voltage. A first stage bandgap reference circuit is biased by a power voltage, where N is a positive integer greater than or equal to 2. The reference voltage generated by each stage of the bandgap reference circuit has an offset, and the offset of the reference voltage of each stage of the bandgap reference circuit is smaller than the offset of the reference voltage of the previous stage bandgap reference circuit.

In an embodiment of the invention, the N-stage bandgap reference circuits have a same circuit configuration.

In an embodiment of the invention, at least one of the N-stage bandgap reference circuits has a circuit configuration different with that of the other bandgap reference circuits.

The invention provides an electronic circuit including a reference power generating circuit and a functional circuit. The reference power generating circuit includes a first bandgap reference circuit, a second bandgap reference circuit and a current generating circuit. The first bandgap reference circuit is biased by a power voltage to generate a first reference voltage, where the first reference voltage has a first offset. The second bandgap reference circuit is connected to the first bandgap reference circuit in series and receives the first reference voltage generated by the first bandgap reference circuit. The second bandgap reference circuit is biased by the first reference voltage to generate a baseline reference voltage, where the baseline reference voltage has a second offset, and the second offset is smaller than the first offset. The current generating circuit is coupled to the second bandgap reference circuit, and is biased by the baseline reference voltage to generate a baseline reference current. The functional circuit is coupled to the reference power generating circuit, and takes at least one of the baseline reference voltage and the baseline reference current as a working reference power.

In an embodiment of the invention, the functional circuit is an oscillating circuit, an analog-to-digital conversion circuit (ADC), a digital-to-analog conversion circuit (DAC), a low drop-out voltage regulator (LDO), a low drift amplifier and a temperature sensor, or one of other analog circuits.

According to the above descriptions, the invention provides a reference power generating circuit and an electronic circuit using the same. In the reference power generating circuit, at least two stages of the bandgap reference circuit can be connected in cascade to suppress relevance between an output of each stage of the bandgap reference circuit and a process-power-temperature characteristic stage-by-stage, so as to generate a high accurate and low noise baseline reference voltage/baseline reference current that is not influenced by a process variation. In this way, the electronic circuit using the reference power generating circuit as a reference power can benefit from the accurate baseline reference voltage/baseline reference current to achieve a good output characteristic.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
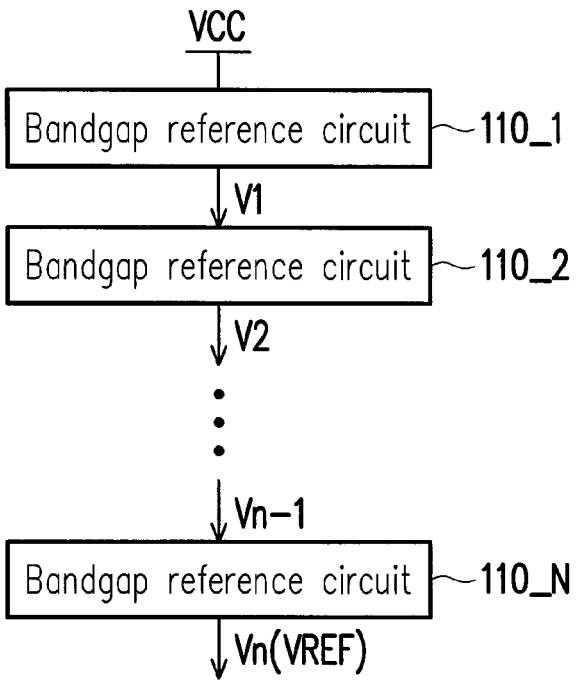
FIG. 1 is a functional block schematic diagram of a reference power generating circuit according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a functional block schematic diagram of a reference power generating circuit according to an embodiment of the invention. Referring to FIG. 1, the reference power generating circuit 100 includes N-stage bandgap reference circuits 110_1-110_N connected in series to each other, where N is a positive integer greater than or equal to 2. In the present embodiment, except the first stage bandgap reference circuit 110_1 is biased by a power voltage VCC to generate a reference voltage V1, each stage of the bandgap reference circuits 110_2-110_N is biased by the output of the previous stage of the bandgap reference circuits 110_1-110_N to generate corresponding reference voltages V2-Vn. Moreover, the reference voltage Vn generated by the last stage bandgap reference circuit 110_N serves as a baseline reference voltage VREF and is provided to other external circuits (not shown) for usage.

For example, the second stage bandgap reference circuit 110_2 is biased by the reference voltage V1 generated by the first stage bandgap reference circuit 110_1 to generate the reference voltage V2, and the third stage bandgap reference circuit 110_3 is biased by the reference voltage V2 generated by the second stage bandgap reference circuit 110_2 to generate the reference voltage V3, and deduced by analogy, the $N^{th}$ stage bandgap reference circuit 110_*n* generates the reference voltage Vn.

In detail, although each stage of the bandgap reference circuits 110_1-110_N has an effect of counteracting a temperature coefficient, limited by non-ideal characteristics and process deviation of components, the reference voltage Vn generated by the single stage of the bandgap reference circuits 110_1-110_N is influenced by a process-voltage-temperature (PVT) characteristic, and has a considerable degree of offset within a specific temperature range.

In the present embodiment, based on a configuration of connecting the bandgap reference circuit 110_1-110_N in cascade, a relevance between the PVT characteristic and the reference voltages V1-Vn output by each stage of the bandgap reference circuits 110_1-110_*n* is suppressed/counteracted stage-by-stage, such that the reference voltage Vn output by the last stage bandgap reference circuit 110_N may have a characteristic of zero temperature coefficient (ZTC). In other words, in the present embodiment, offsets of the reference voltages V1-Vn generated by each stage of the bandgap reference circuits 110_1-110_N are respectively smaller than the offsets of the reference voltages V1-Vn generated by the previous stage of the bandgap reference circuits 110_1-110_N. Namely, the baseline reference voltage VREF (Vn) finally serving as the output of the reference power generating circuit 100 may have the minimum offset (i.e., the relevance with the PVT characteristic is the minimum) compared with the outputs of the other stages of the bandgap reference circuits 110_1-110_N.

Therefore, according to the description of the present embodiment, a designer can design the baseline reference voltage VREF with characteristics of high accuracy, stable, low noise and high power suppress by applying the circuit configuration of connecting the bandgap reference circuits 110_1-110_N in series (i.e., in cascade). Comparing with the conventional configuration of adding an additional compensation circuit in a bandgap reference circuit, the cost of the present embodiment is effectively decreased.

Moreover, in an exemplary embodiment, since each stage of the bandgap reference circuits 110_1-110_N may have the same circuit configuration, the circuit layout may have higher symmetry, so as to decrease sensitivity of the reference power generating circuit 100 on process variation. However, the invention is not limited thereto. In another exemplary embodiment, at least one of the bandgap reference circuits 110_1-110_N may have a different circuit configuration with that of the other bandgap reference circuits 110_1-110_N according to a design requirement/consideration of the designer, so as to improve the performance of the whole reference power generating circuit 100 in allusion to a specific requirement.

Figure 2:
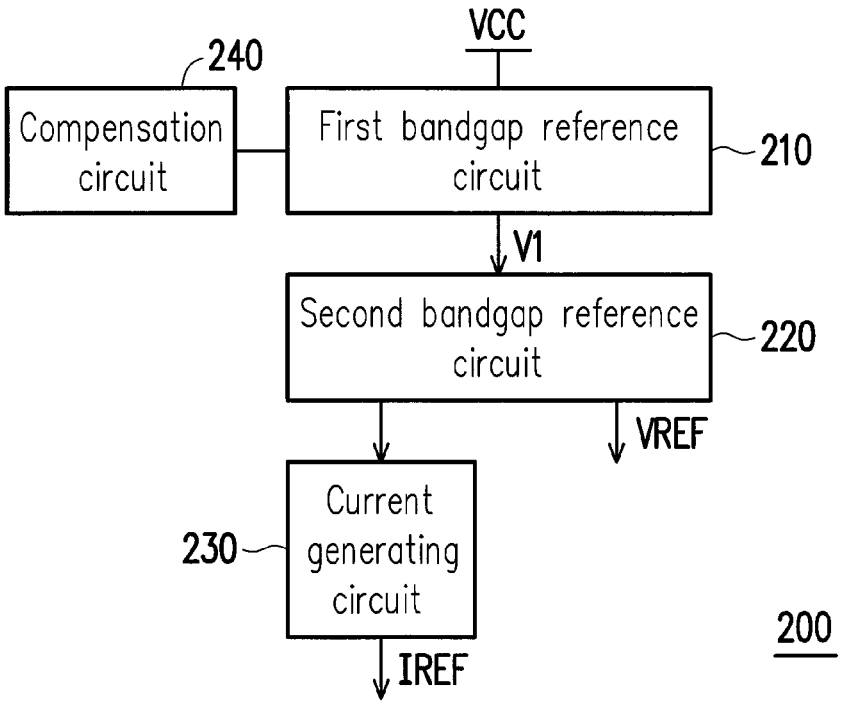
FIG. 2 is a functional block schematic diagram of a reference power generating circuit according to another embodiment of the invention.

FIG. 2 is a functional block schematic diagram of a reference power generating circuit according to another embodiment of the invention. In the present embodiment, two stages of bandgap reference circuits 210 and 220 connected in series are taken as an example for description (i.e., N=2), though the invention is not limited thereto.

Referring to FIG. 2, the reference power generating circuit 200 includes the first bandgap reference circuit 210, the second bandgap reference circuit 220, a current generating circuit 230 and a compensation circuit 240. The first bandgap reference circuit 210 and the second bandgap reference circuit 220 are connected in cascade. The current generating circuit 230 is coupled to the second bandgap reference circuit 220. The compensation circuit 240 is coupled to the first bandgap reference circuit 210.

In the present embodiment, the first bandgap reference circuit 210 is biased by the power voltage VCC to generate a reference voltage V1. The second bandgap reference circuit 220 is biased by the reference voltage V1 generated by the first bandgap reference circuit 210 to generate a baseline reference voltage VREF. As described above, since the second bandgap reference circuit 220 of the post stage can further suppress the relevance between the baseline reference voltage VREF and the PVT characteristic, an offset of the baseline reference voltage VREF is smaller than an offset of the reference voltage V1. To be specific, in the embodiment of the invention, a relative relationship between the baseline reference voltage VREF and temperature is that each time when the temperature is increased by 1° C., the voltage value only has a variation/offset below 10 ppm (i.e. 1/100000 volts).

The current generating circuit 230 receives the baseline reference voltage VREF output by the second bandgap reference circuit 220, and is biased by the baseline reference voltage VREF to generate a baseline reference current IREF. In this way, since the baseline reference voltage VREF generated by the second bandgap reference circuit 220 has a characteristic of low offset, the current generating circuit 230 biased by the baseline reference voltage VREF is also not influenced by the PVT characteristic, so as to generate the accurate and stable baseline reference current IREF.

The compensation circuit 240 is configured to perform a first-order or multi-order compensation on the first bandgap reference circuit 210, such that the offset of the reference voltage V1 generated by the first bandgap reference circuit 210 can be decreased in response to the compensation of the compensation circuit 240. Therefore, the second bandgap reference circuit 220 can be biased by the reference voltage V1 with lower offset to generate the baseline reference voltage VREF, such that the generated baseline reference voltage VREF may have better stability. In other words, the offsets of the reference voltage V1 and the baseline reference voltage VREF are simultaneously decreased in response to the compensation of the compensation circuit 240. The compensation circuit 240 is, for example, second-order temperature compensation circuit and/or three or more than three-order temperature compensation circuit, which is not limited by the invention.

It should be noticed that in the present embodiment, configuration of the current generating circuit 230 and the compensation circuit 240 is selectable. In other words, the reference power generating circuit 200 is basically composed of the first bandgap reference circuit 210 and the second bandgap reference circuit 220. The designer can determine whether or not to add the current generating circuit 230 and/or the compensation circuit 240 according to an actual design requirement, which is not limited by the invention.

Besides, in an exemplary embodiment, the first bandgap reference circuit 210 and the second bandgap reference circuit 220 can be integrated to form a reference voltage generating circuit/chip. In another exemplary embodiment, the first bandgap reference circuit 210, the second bandgap reference circuit 220 and the current generating circuit 230 can be integrated to form a reference current generating circuit/chip. In other words, detailed circuit implementation of the reference power generating circuit 200 is not limited by the invention, and as long as the circuit structure has at least two stages of bandgap reference circuits connected in cascade, it is considered to be within the scope of the invention.

Figure 3:
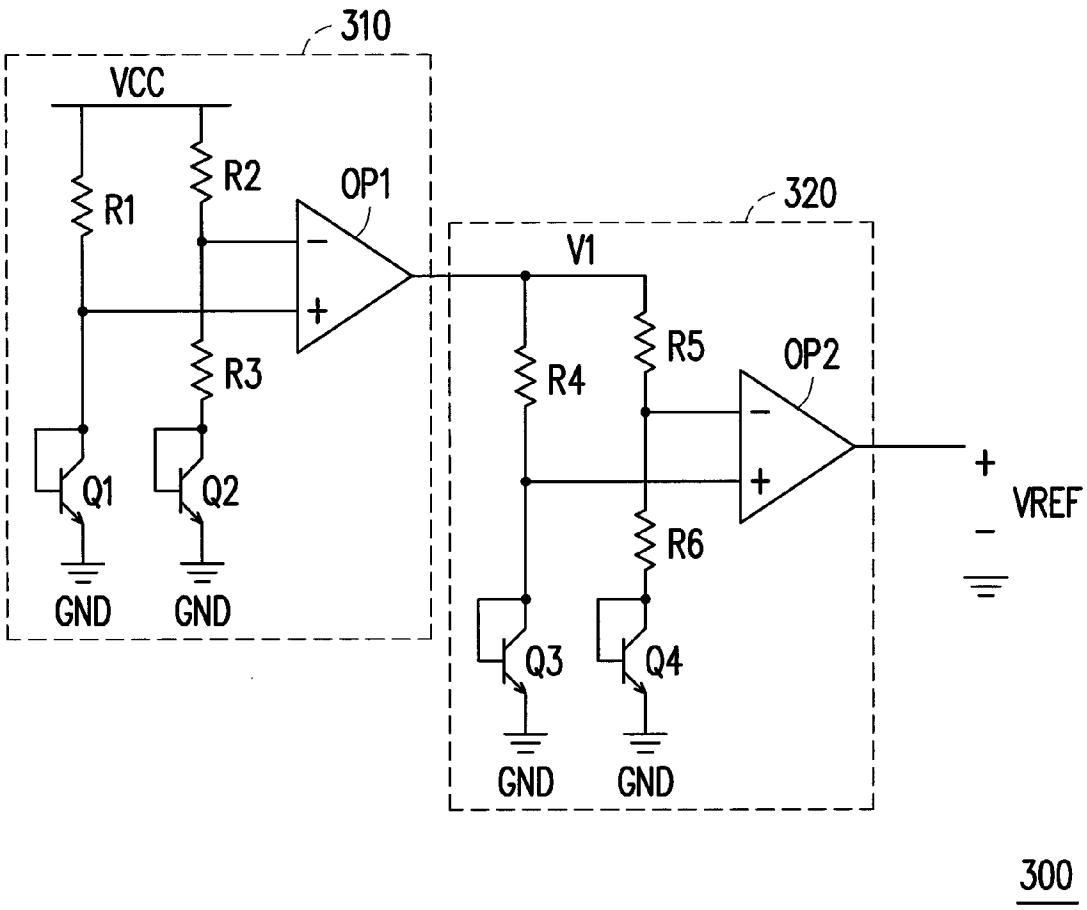
FIG. 3 is a circuit schematic diagram of a reference power generating circuit according to an embodiment of the invention.
Figure 4:
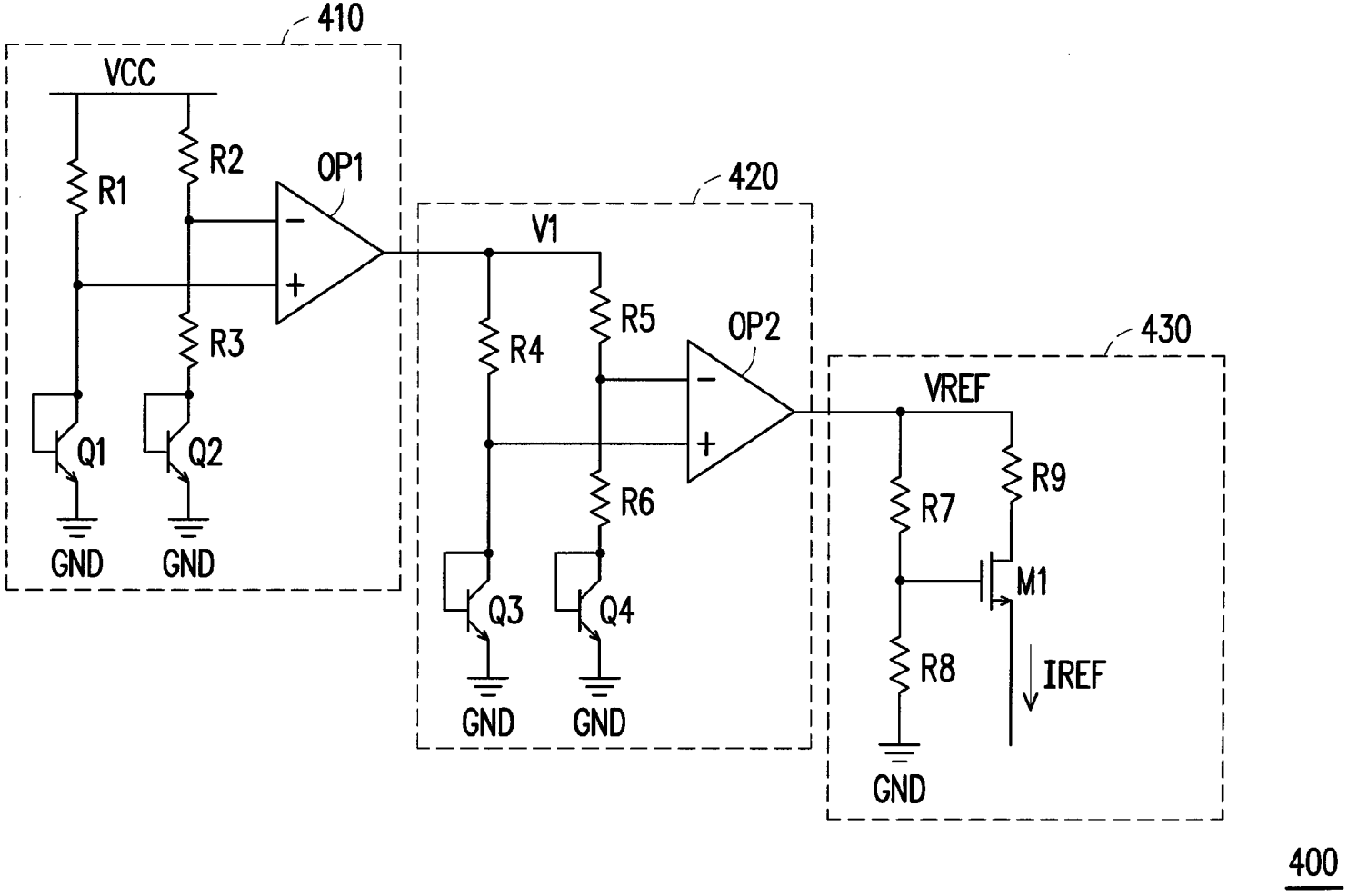
FIG. 4 is a circuit schematic diagram of a reference power generating circuit according to another embodiment of the invention.

Circuit structures of FIG. 3 and FIG. 4 are provided below to describe detailed implementations of the reference power generating circuit of the invention. FIG. 3 and FIG. 4 are circuit schematic diagrams of the reference power generating circuit according to different embodiments of the invention.

Referring to FIG. 3, the reference power generating circuit 300 includes a first bandgap reference circuit 310 and a second bandgap reference circuit 320. The first bandgap reference circuit 310 is, for example, a circuit structure composed of transistors Q1 and Q2, resistors R1, R2 and R3 and an amplifier OP1. The second bandgap reference circuit 320 is, for example, a circuit structure composed of transistors Q3 and Q4, resistors R4, R5 and R6 and an amplifier OP2. In the present embodiment, the first bandgap reference circuit 310 and the second bandgap reference circuit 320, for example, have a same circuit configuration. In following description, the circuit structure of the first bandgap reference circuit 310 is mainly described, and the circuit structure of the second bandgap reference circuit 320 may refer to that of the first bandgap reference circuit 310, and details thereof are not repeated.

In detail, in the first bandgap reference circuit 310, the transistors Q1 and Q2 are, for example, npn-type bipolar junction transistors (BJT) (though the invention is not limited thereto, and pnp-type BJT can also be applied). Bases of the transistors Q1 and Q2 are respectively coupled to collectors of the transistors Q1 and Q2. Emitters of the transistors Q1 and Q2 are coupled to a ground terminal GND. A first end of the resistor R1 is coupled to the power voltage VCC, and a second end of the resistor R1 is coupled to the collector of the transistor Q1. A first end of the resistor R2 is coupled to the power voltage VCC. A first end of the resistor R3 is coupled to a second end of the resistor R2, and a second end of the resistor R3 is coupled to the collector of the transistor Q2. A positive input terminal of the amplifier OP1 is coupled to the second end of the resistor R1 and the collector of the transistor Q1. A negative input terminal of the amplifier OP1 is coupled to a common node (the second end of the resistor R2/the first end of the resistor R3) of the resistor R2 and the resistor R3. An output terminal of the amplifier OP1 outputs the reference voltage V1 to the second bandgap reference circuit 320.

In the bandgap reference circuit 310 of the present embodiment, as the base-emitter of the transistors Q1 and Q2 have a negative temperature coefficient relationship, voltage differences produced by the transistors Q1 and Q2 operated under different current densities have a positive temperature coefficient relationship, the amplifier OP1 adds the two voltages (i.e. voltages at the second ends of the resistor R1 and the resistor R2) to obtain the reference voltage V1 with low relevance to temperature.

On the other hand, in the second bandgap reference circuit 30, the circuit structure thereof is similar to that of the first bandgap reference circuit, and a difference there between is that first ends of the resistors R4 and R5 of the second bandgap reference circuit 320 are coupled to the output terminal of the amplifier OP1. In other words, the second bandgap reference circuit 320 is biased by the reference voltage V1 output by the amplifier OP1 to generate the baseline reference voltage VREF. Operation details that the second bandgap reference circuit 320 generates the baseline reference voltage VREF with low relevance to temperature are similar to that of the first bandgap reference circuit 310, which are not repeated.

Referring to FIG. 4, the reference power generating circuit 400 includes a first bandgap reference circuit 410, a second bandgap reference circuit 420 and a current generating circuit 430. Circuit structures of the first bandgap reference circuit 410 (including transistors Q1 and Q2, resistors R1, R2 and R3 and an amplifier OP1) and the second bandgap reference circuit 420 (including transistors Q3 and Q4, resistors R4, R5 and R6 and an amplifier OP2) of the present embodiment are similar as that described in the embodiment of FIG. 3, and details thereof are not repeated. A detailed circuit structure of the current generating circuit 430 is described below.

The current generating circuit 430 includes a transistor M1 and resistors R7, R8 and R9. In the present embodiment, the transistor is, for example, an N-type metal oxide semiconductor field effect transistor (MOSFET) (though the invention is not limited thereto, and a P-type MOSFET can also be applied). A first end of the resistor R7 is coupled to the output terminal of the amplifier OP2 in the second bandgap reference circuit 420, and a second end of the resistor R7 is coupled to a gate of the transistor M1. A first end of the resistor R8 is coupled to the second end of the resistor R7 and the gate of the transistor M1, and a second end of the resistor R8 is coupled to the ground terminal GND. A first end of the resistor R9 is coupled to the output terminal of the amplifier OP2 in the second bandgap reference circuit 420, and a second end of the resistor R9 is coupled to a drain of the transistor M1. A source of the transistor M1 can serve as a current output terminal of the current generating circuit 430 to output the baseline reference current IREF to a corresponding functional circuit (not shown).

It should be noticed that the circuit structures of FIG. 3 and FIG. 4 are only examples of the reference power generating circuit of the invention, and are not used to limit the scope of the invention. Those skilled in the art can implement the reference power generating circuit of the invention by using any existing bandgap reference circuit according to the aforementioned descriptions of the invention.

Figure 5:
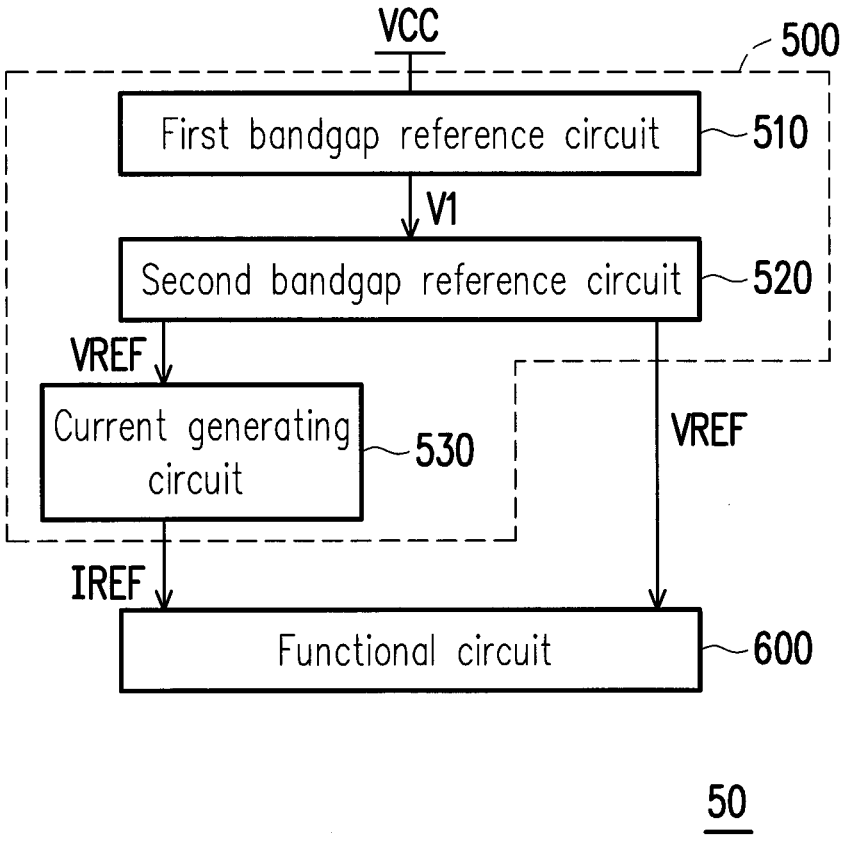
FIG. 5 is a functional block schematic diagram of an electronic circuit according to an embodiment of the invention.

In view of a practical application, the reference power generating circuits (for example, 100, 200, 300, 400) of the embodiments of FIG. 1 to FIG. 4 can be applied to an electronic circuit shown in FIG. 5 to serve as a reference power source of a specific functional circuit. FIG. 5 is a functional block schematic diagram of an electronic circuit according to an embodiment of the invention.

Referring to FIG. 5, the electronic circuit 50 includes a reference power generating circuit 500 as that described in the aforementioned embodiments and a functional circuit 600. The reference power generating circuit 500 includes a first bandgap reference circuit 510, a second bandgap reference circuit 520 and a current generating circuit 530. Besides, the first bandgap reference circuit 510 and the second bandgap reference circuit 520 are, for example, connected to each other in cascade as that described in the aforementioned embodiments, so as to produce the baseline reference voltage VREF. The current generating circuit 530 is biased by the baseline reference voltage VREF generated by the second bandgap reference circuit 520 to generate the baseline reference current IREF.

In the present embodiment, the reference voltage generating circuit 500 provides at least one of the baseline reference voltage VREF and the baseline reference current IREF to the functional circuit 600 to serve as a working reference power (which is determined according to a requirement of the functional circuit 600) of the functional circuit 600. In this way, the functional circuit 600 can execute corresponding circuit operations according to the baseline reference voltage VREF and the baseline reference current IREF that are accurate and are not influenced by noise and the PVT characteristic.

For example, the functional circuit 600 is, for example, an oscillating circuit. To be specific, the functional circuit 600 is, for example, a circuit that maintains an oscillating frequency according to the reference voltage such as a resistance-capacitance (RC) oscillator, a ring oscillator or a relaxation oscillator, etc. Based on the high-accurate baseline reference voltage VREF, the oscillating circuit may have an oscillating frequency that is more stable and is not influenced by the PVT characteristic.

Besides, the functional circuit 600 is not limited to the oscillating circuit, but can be an analog circuit of any type, and particularly a circuit requiring the high-accurate working reference power, such as an analog-to-digital conversion circuit (ADC), a digital-to-analog conversion circuit (DAC), a low drop-out voltage regulator (LDO), a low drift amplifier or a temperature sensor, etc., which can all adopt the reference power generating circuit of the invention to serve as a reference power to achieve a better output characteristic.

In summary, the invention provides a reference power generating circuit and an electronic circuit using the same. In the reference power generating circuit, at least two stages of the bandgap reference circuit can be connected in cascade to suppress relevance between an output of each stage of the bandgap reference circuit and a process-power-temperature characteristic stage-by-stage, so as to generate a high accurate and low noise baseline reference voltage/baseline reference current that is not influenced by a process variation. In this way, the electronic circuit using the reference power generating circuit as a reference power can benefit from the accurate baseline reference voltage/baseline reference current to achieve a good output characteristic.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A reference power generating circuit, comprising:

a first bandgap reference circuit, biased by a power voltage to generate a first reference voltage, wherein the first reference voltage has a first offset;

a second bandgap reference circuit, connected to the first bandgap reference circuit in series and receiving the first reference voltage generated by the first bandgap reference circuit, and biased by the first reference voltage to generate a baseline reference voltage, wherein the baseline reference voltage has a second offset;

a current generating circuit, directly coupled to the second bandgap reference circuit, and biased by the baseline reference voltage to generate a baseline reference current; and at least one compensation circuit, configured to perform a first-order or multi-order compensation on the first bandgap reference circuit, so as to simultaneously decrease the first offset and the second offset, wherein the second offset is smaller than the first offset, and the first and the second bandgap reference circuits have a same circuit configuration.

2. A reference power generating circuit, comprising:

N-stage bandgap reference circuits connected in series to each other, wherein each stage of the bandgap reference circuit is biased by an output of a previous stage bandgap reference circuit to generate a reference voltage, a first stage bandgap reference circuit is biased by a power voltage, and N is a positive integer greater than or equal to 2;

a current generating circuit, directly coupled to the last stage bandgap reference circuit, and biased by the reference voltage generated by the last stage bandgap reference circuit to generate a baseline reference current; and at least one compensation circuit, configured to perform a first-order or multi-order compensation on at least one of the N-stage bandgap reference circuits, so as to simultaneously decrease the offsets of each stage of the bandgap reference circuit, wherein the reference voltage generated by each stage of the bandgap reference circuit has an offset, and the offset of the reference voltage of each stage of the bandgap reference circuit is smaller than the offset of the reference voltage of the previous stage bandgap reference circuit, and the N-stage bandgap reference circuits have a same circuit configuration.

3. An electronic circuit, comprising:

a reference power generating circuit, comprising:

a first bandgap reference circuit, biased by a power voltage to generate a first reference voltage, wherein the first reference voltage has a first offset;

a second bandgap reference circuit, connected to the first bandgap reference circuit in series and receiving the first reference voltage generated by the first bandgap reference circuit, and biased by the first reference voltage to generate a baseline reference voltage, wherein the baseline reference voltage has a second offset, the second offset is smaller than the first offset, and the first and the second bandgap reference circuits have a same circuit configuration; and a current generating circuit, directly coupled to the second bandgap reference circuit, and biased by the baseline reference voltage to generate a baseline reference current;

a functional circuit, coupled to the reference power generating circuit, and taking at least one of the baseline reference voltage and the baseline reference current as a working reference power; and at least one compensation circuit, configured to perform a first-order or multi-order compensation on the first bandgap reference circuit, so as to simultaneously decrease the first offset and the second offset.

4. The electronic circuit as claimed in claim 3, wherein the functional circuit is one of an oscillating circuit, an analog-to-digital conversion circuit (ADC), a digital-to-analog conversion circuit (DAC), a low drop-out voltage regulator (LDO), a low drift amplifier and a temperature sensor.

* * * * *